US012467317B2

(12) United States Patent
Mantle et al.

(10) Patent No.: US 12,467,317 B2
(45) Date of Patent: Nov. 11, 2025

(54) AUTOMATED CONTROL OF TRAJECTORY OF DOWNHOLE DRILLING

(71) Applicant: Schlumberger Technology Corporation, Sugar Land, TX (US)

(72) Inventors: Katharine Mantle, Cheltenham (GB); Maja Ignova, Cheltenham (GB); Ekaterina Brovko, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/643,751

(22) Filed: Apr. 23, 2024

(65) Prior Publication Data

US 2024/0352802 A1 Oct. 24, 2024

Related U.S. Application Data

(60) Provisional application No. 63/497,831, filed on Apr. 24, 2023.

(51) Int. Cl.
*E21B 7/06* (2006.01)
*E21B 41/00* (2006.01)
*E21B 44/00* (2006.01)

(52) U.S. Cl.
CPC ..... *E21B 7/06* (2013.01); *E21B 41/0007* (2013.01); *E21B 44/005* (2013.01)

(58) Field of Classification Search
CPC ... E21B 7/04; E21B 7/06; E21B 44/00; E21B 44/005
See application file for complete search history.

(56) References Cited

U.S. PATENT DOCUMENTS

| | | | | |
|---|---|---|---|---|
| 4,762,186 | A | 8/1988 | Dech et al. | |
| 6,408,952 | B1 * | 6/2002 | Brand | E21B 44/00 175/45 |
| 7,584,788 | B2 | 9/2009 | Baron et al. | |
| 8,783,382 | B2 * | 7/2014 | Ignova | E21B 7/04 702/9 |
| 9,273,547 | B2 | 3/2016 | Brooks et al. | |
| 9,784,089 | B2 * | 10/2017 | Boone | E21B 44/02 |
| 9,850,712 | B2 * | 12/2017 | Sugiura | E21B 44/005 |
| 9,945,222 | B2 * | 4/2018 | Sugiura | E21B 44/005 |
| 9,982,525 | B2 | 5/2018 | Brooks et al. | |
| 10,214,964 | B2 * | 2/2019 | Hornblower | E21B 7/06 |
| 10,760,341 | B2 * | 9/2020 | Gorrara | E21B 47/022 |
| 10,844,703 | B2 * | 11/2020 | Jones | E21B 44/005 |
| 10,995,552 | B2 * | 5/2021 | Hornblower | E21B 47/022 |
| 10,995,604 | B2 * | 5/2021 | Hornblower | E21B 7/04 |

(Continued)

FOREIGN PATENT DOCUMENTS

| | | | | |
|---|---|---|---|---|
| WO | WO-2014160567 A1 * | 10/2014 | | E21B 44/005 |
| WO | WO-2021236877 A1 * | 11/2021 | | E21B 41/00 |
| WO | 2022133484 A1 | 6/2022 | | |

*Primary Examiner* — Jennifer H Gay

(57) ABSTRACT

Methods and systems are provided for automated closed-loop control of drilling trajectory during directional drilling, which automatically adjusts at least one parameter during the directional drilling to automatically control the direction of drilling when drilling a kickoff that transitions a wellbore from a vertical section to a curve or tangent section. In embodiments, the closed-loop control can be configured to automatically adjust a steering ratio (SR) parameter that controls time that a steering tool will spend in holding a desired magnetic toolface.

20 Claims, 8 Drawing Sheets

(56) References Cited

U.S. PATENT DOCUMENTS 11,802,473 B2 * 10/2023 Neufeldt ..... E21B 44/06
12,086,515 B2 * 9/2024 Guillot ..... G06F 30/27
12,106,028 B2 * 10/2024 Ozbek ..... E21B 41/00
12,116,887 B2 * 10/2024 Hamzah ..... E21B 47/12
2009/0000823 A1 * 1/2009 Pirovolou ..... E21B 7/04 175/61
2010/0175922 A1 * 7/2010 Ignova ..... E21B 7/04 175/24
2011/0213601 A1 * 9/2011 Pirovolou ..... E21B 7/04 703/10
2013/0126239 A1 * 5/2013 Panchal ..... G05B 15/02 175/24
2014/0151121 A1 * 6/2014 Boone ..... E21B 44/00 175/27
2015/0167392 A1 * 6/2015 Sugiura ..... E21B 7/04 175/45
2015/0377004 A1 * 12/2015 Hornblower ..... E21B 7/06 175/24
2016/0160628 A1 * 6/2016 Sugiura ..... E21B 7/06 700/275
2017/0254190 A1 * 9/2017 Jones ..... E21B 4/20
2017/0370152 A1 * 12/2017 Samuel ..... E21B 47/12
2018/0363444 A1 * 12/2018 Hornblower ..... E21B 45/00
2019/0145173 A1 * 5/2019 Hornblower ..... E21B 7/06 702/9
2021/0270088 A1 * 9/2021 Hornblower ..... E21B 45/00
2023/0038752 A1 * 2/2023 Hamzah ..... E21B 47/26
2023/0046043 A1 * 2/2023 Hansen ..... E21B 7/06
2023/0130310 A1 * 4/2023 Ignova ..... E21B 7/068 175/45
2023/0186000 A1 * 6/2023 Ozbek ..... E21B 41/00 175/61
2023/0195952 A1 * 6/2023 Guillot ..... E21B 49/00 175/24
2024/0352800 A1 * 10/2024 Ignova ..... E21B 7/06
2024/0352802 A1 * 10/2024 Mantle ..... E21B 7/064
2024/0352843 A1 * 10/2024 Tasoujian ..... E21B 7/06
2024/0352844 A1 * 10/2024 Mantle ..... E21B 7/04
2025/0059834 A1 * 2/2025 Sahli ..... E21B 44/00
2025/0075609 A1 * 3/2025 Ba ..... E21B 47/024

* cited by examiner

AUTOMATED CONTROL OF TRAJECTORY OF DOWNHOLE DRILLING

CROSS-REFERENCE TO RELATED APPLICATION(S)

The present disclosure claims priority from U.S. Provisional Appl. No. 63/497,831, filed on Apr. 24, 2023, entitled "AUTOMATED CONTROL OF TRAJECTORY OF DOWNHOLE DRILLING", herein incorporated by reference in its entirety.

FIELD

Disclosed embodiments relate generally to methods and systems for directional control during downhole directional drilling operations.

BACKGROUND

The use of directional drilling methods is becoming increasingly common in drilling subterranean wellbores. One difficulty with directional drilling methods is that they tend to drill in a direction offset from the set point direction. These tendencies can be influenced by numerous factors and may change unexpectedly during a drilling operation. Factors that can influence this directional tendency may include, for example, properties of the subterranean formation, the configuration of the bottom hole assembly (BHA), bit wear, bit/stabilizer walk, an unplanned touch point (e.g., due to compression and buckling of the BHA), stabilizer-formation interaction, the steering mechanism utilized by the drilling tool, and various drilling parameters.

The steering mechanisms used for directional drilling methods have a toolface which is part of a deflection tool or a steerable motor system. This toolface is oriented in a particular direction to make a desired deflection while drilling a wellbore. In current directional drilling methods, a magnetic toolface is used to represent the orientation of the toolface when the wellbore being drilled has an inclination that is less than a predefined threshold (such as less than 8°), and a gravity toolface is used to represent the orientation of the toolface when the wellbore being drilled has an inclination that is greater than the predefined threshold (such as greater than 8°). Magnetic toolface is a toolface orientation measured as an angle between the tool reference axis and magnetic north in a horizontal plane. Gravity toolface is a toolface orientation measured as an angle between the tool reference axis and gravity in a vertical plane.

Directional drilling methods often transition from drilling a vertical section of the wellbore to a curved or tangent section of the wellbore. This transition is typically referred to as kickoff. In current directional drilling methods, kickoff is typically implemented manually by the drilling operator downlinking a magnetic toolface and steering ratio (SR) parameter. The magnetic toolface represents the direction to drill and the SR parameter represents the time that the steering mechanism will spend in holding the desired magnetic toolface and then drilling ahead, adjusting these parameters as required. Once free from magnetic interference, the drilling operator will manually switch from using magnetic toolface to using gravity toolface and continue the drilling sending gravity toolface and SR parameters as required. Sometimes, this manual transition from magnetic toolface to gravity toolface can cause anomalies to inclination and azimuth smoothness as well as anomalies in consistency of dog leg severity of the wellbore in the kickoff.

SUMMARY

This summary is provided to introduce a selection of concepts that are further described below in the detailed description. This summary is not intended to identify key features of the claimed subject matter, nor is it intended to be used as an aid in limiting the scope of the claimed subject matter.

Methods and systems are provided for automated closed-loop control of drilling trajectory during directional drilling, which automatically adjusts at least one parameter during the directional drilling to automatically control the direction of drilling when drilling a kickoff that transitions a wellbore from a vertical section to a curve or tangent section.

In embodiments, the closed-loop control can be configured to automatically adjust a steering ratio (SR) parameter that controls time that a steering tool will spend in holding a desired magnetic toolface. The SR parameter determines the dog leg severity (DLS) of the tool response during drilling.

In embodiments, the closed-loop control can be configured to automatically adjust the steering ratio (SR) parameter based on a difference or error between a target dog leg severity (Target_DLS) and an estimated dog leg severity (DLS*) calculated from tool response.

In embodiments, the closed-loop control can be configured to adjust the steering ratio (SR) parameter based on difference or error between a target build rate parameter (Target_BR) and an estimated build rate parameter (BR*) calculated from the tool response.

In embodiments, the closed-loop control can be configured to adjust the steering ratio (SR) parameter based on at least one of i) difference or error between a target inclination and measured inclination of the steering tool and ii) difference or error between a target build rate and a current build rate calculated from the measured inclination of the steering tool.

In embodiments, the adjustment of the steering ratio (SR) parameter can be based on a number of inputs selected from the group including a desired magnetic toolface, a target dog leg severity, a target build rate, a rate of penetration (ROP), and drilling state parameters. In embodiments, at least one of the inputs can be downlinked by a user or from a machine that supervises and automatically sends the inputs.

In embodiments, the closed-loop control can be configured to terminate the automatic adjusting of the steering ratio (SR) parameter or switch to another control mode when inclination of the steering tool exceeds a predetermined threshold value.

In embodiments, the closed-loop control can be further configured to automatically adjust magnetic toolface of the steering tool if the magnitude of the difference between the desired magnetic toolface and azimuth of the steering tool at a predefined inclination angle of the steering tool exceeds a predetermined threshold value.

In embodiments, the adjustment of the steering ratio (SR) parameter can be based on a ramp of multiple magnetic toolfaces or magnetic toolface set-point nudges using estimated or elapsed measured depth during drilling.

In embodiments, the adjusting of the at least one parameter can be activated manually by instructions from a drilling operator or automatically by instructions from a processor or other programmed controller during directional drilling.

In embodiments, the adjusting of the at least one parameter can be performed by a downhole processor or controller.

The disclosed embodiments may provide various technical advantages. For example, the disclosed embodiments provide for real-time closed loop control of the drilling toolface. As such, the disclosed methods may provide for improved well placement and reduced wellbore tortuosity. Moreover, by providing for closed loop control, the disclosed methods tend to improve drilling efficiency and consistency.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Figure 1:
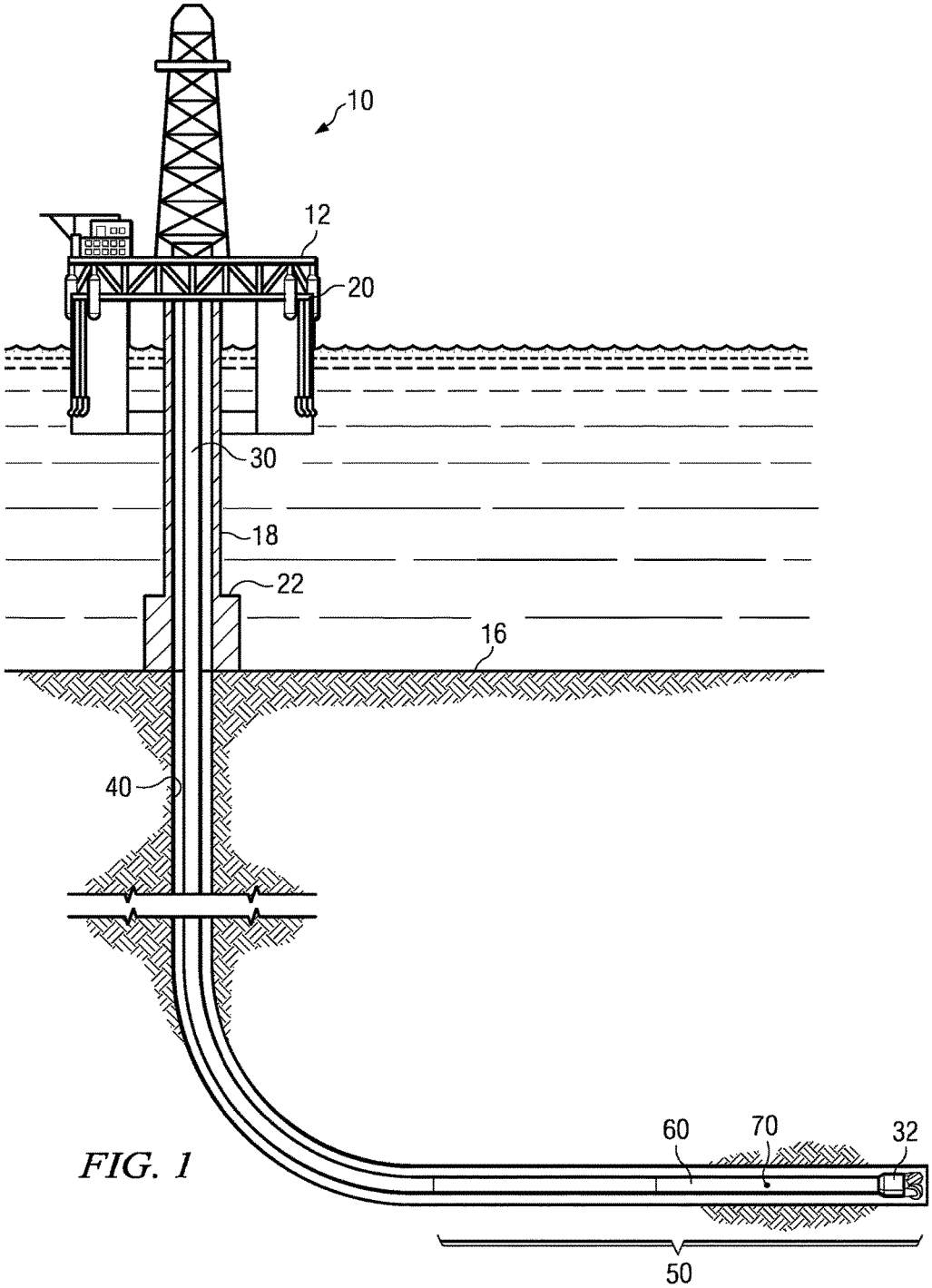
FIG. 1 depicts an example drilling rig on which disclosed embodiments may be utilized.

FIG. 1 depicts a drilling rig 10 suitable for using various method and system embodiments disclosed herein. A semi-submersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a bottom hole assembly (BHA) 50. The BHA 50 includes a drill bit 32, a steering tool 60 (also referred to as a directional drilling tool), and one or more downhole navigation sensors 70 such as measurement while drilling sensors including three axis accelerometers and/or three axis magnetometers. The BHA 50 may further include substantially any other suitable downhole tools such as a downhole drilling motor, a downhole telemetry system, a reaming tool, and the like. The disclosed embodiments are not limited with regard to such other tools.

It will be understood that the BHA may include substantially any suitable steering tool 60, for example, including a deflection tool or a rotary steerable system. Various rotary steerable tool configurations are known in the art including various steering mechanisms for controlling the direction of drilling.

For example, in one embodiment, the BHA 50 may include deflector tools that includes a substantially non-rotating outer housing employing blades that engage the wellbore wall. Engagement of the blades with the wellbore wall can be controlled to vary the attitude of the drill bit during drilling, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the wellbore wall.

In another embodiment, the BHA 50 can include a rotary steerable system, such as the PowerDrive rotary steerable system available from SLB which fully rotates with the drill string (i.e., the outer housing rotates with the drill string). The PowerDrive Xceed makes use of an internal steering mechanism that is not requiring contact with the wellbore wall and enables the tool body to fully rotate with the drill string. The PowerDrive X5, X6, and POWERDRIVE ORBIT® rotary steerable systems make use of mud actuated blades (or pads) that contact the wellbore wall. The extension of the blades (or pads) is rapidly and continually adjusted as the system rotates in the wellbore. The POWERDRIVE ARCHER® makes use of a lower steering section joined at an articulated swivel with an upper section. The swivel is actively tilted via pistons so as to change the angle of the lower section with respect to the upper section and maintain a desired drilling direction as the bottom hole assembly rotates in the wellbore. Accelerometer and magnetometer sets may rotate with the drill string or may alternatively be deployed in an internal roll-stabilized housing such that they remain substantially stationary (in a bias phase) or rotate slowly with respect to the wellbore (in a neutral phase). To drill a desired curvature, the bias phase and neutral phase are alternated during drilling at a predetermined ratio (referred to as the steering ratio). Again, the disclosed embodiments are not limited to use with any particular steering tool configuration.

The downhole sensors 70 may include substantially any suitable sensor arrangement used making downhole navigation measurements (wellbore inclination, wellbore azimuth, and/or tool face measurements). Such sensors may include, for example, accelerometers, magnetometers, gyroscopes, and the like. Such sensor arrangements are well known in the art and are therefore not described in further detail. The disclosed embodiments are not limited to the use of any particular sensor embodiments or configurations. Methods for making real-time while drilling measurements of the wellbore inclination and wellbore azimuth are disclosed, for example, in commonly assigned U.S. Pat. Nos. 9,273,547 and 9,982,525. In the depicted embodiment, the sensors 70 are shown to be deployed in the steering tool 60. Such a depiction is merely for convenience as the sensors 70 may be deployed elsewhere in the BHA.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
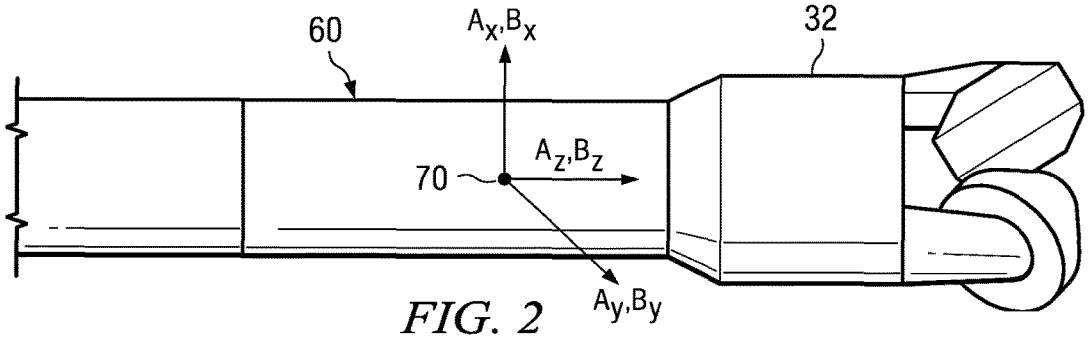
FIG. 2 depicts a lower BHA portion of the drill string shown on FIG. 1.

FIG. 2 depicts the lower BHA portion of drill string 30 including drill bit 32 and steering tool 60. As described above with respect to FIG. 1, the steering tool may include navigation sensors 70 including tri-axial (three axis) accelerometer and magnetometer navigation sensors. Suitable accelerometers and magnetometers may be chosen from among substantially any suitable commercially available devices known in the art. FIG. 2 further includes a diagrammatic representation of the tri-axial accelerometer and magnetometer sensor sets. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right-handed system is designated in which the z-axis accelerometer and magnetometer ($A_z$ and $B_z$) are oriented substantially parallel with the wellbore as indicated (although disclosed embodiments are not limited by such conventions). Each of the accelerometer and magnetometer sets may therefore be considered as determining a plane (the x and y-axes) and a pole (the z-axis along the axis of the BHA).

Figure 3:
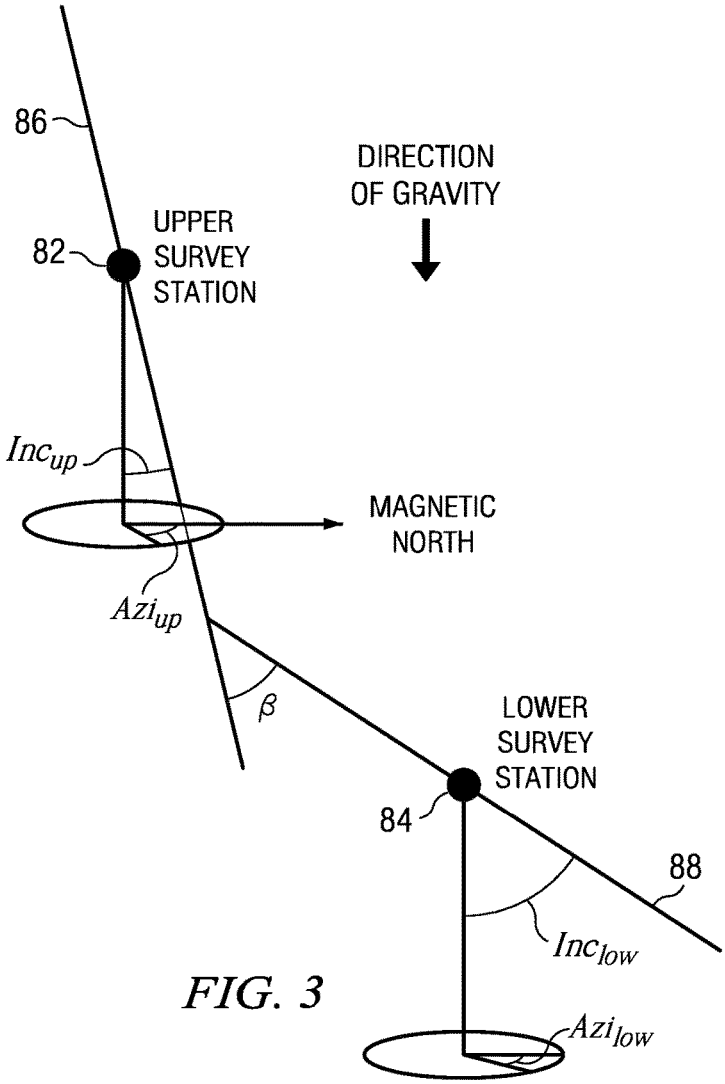
FIG. 3 depicts a diagram of attitude and steering parameters in a global coordinate reference frame.

FIG. 3 depicts a diagram of attitude in a global coordinate reference frame at first and second upper and lower survey stations 82 and 84. The attitude of a BHA defines the orientation of the BHA axis (axis 86 at the upper survey station 82 and axis 88 at the lower survey station 84) in three-dimensional space. In wellbore surveying applications, the wellbore attitude represents the direction of the BHA axis in the global coordinate reference frame (and is commonly understood to be approximately equal to the direction of propagation of the drill bit). Attitude may be represented by a unit vector, the direction of which is often defined by the wellbore inclination and the wellbore azimuth. In FIG. 2, the wellbore inclination at the upper and lower survey stations 82 and 84 is represented by $Inc_{up}$ and $Inc_{low}$ while the wellbore azimuth is represented by $Azi_{up}$ and $Azi_{low}$. The angle β represents the overall angle change of the wellbore between the first and second survey stations 82 and 84.

Figure 4:
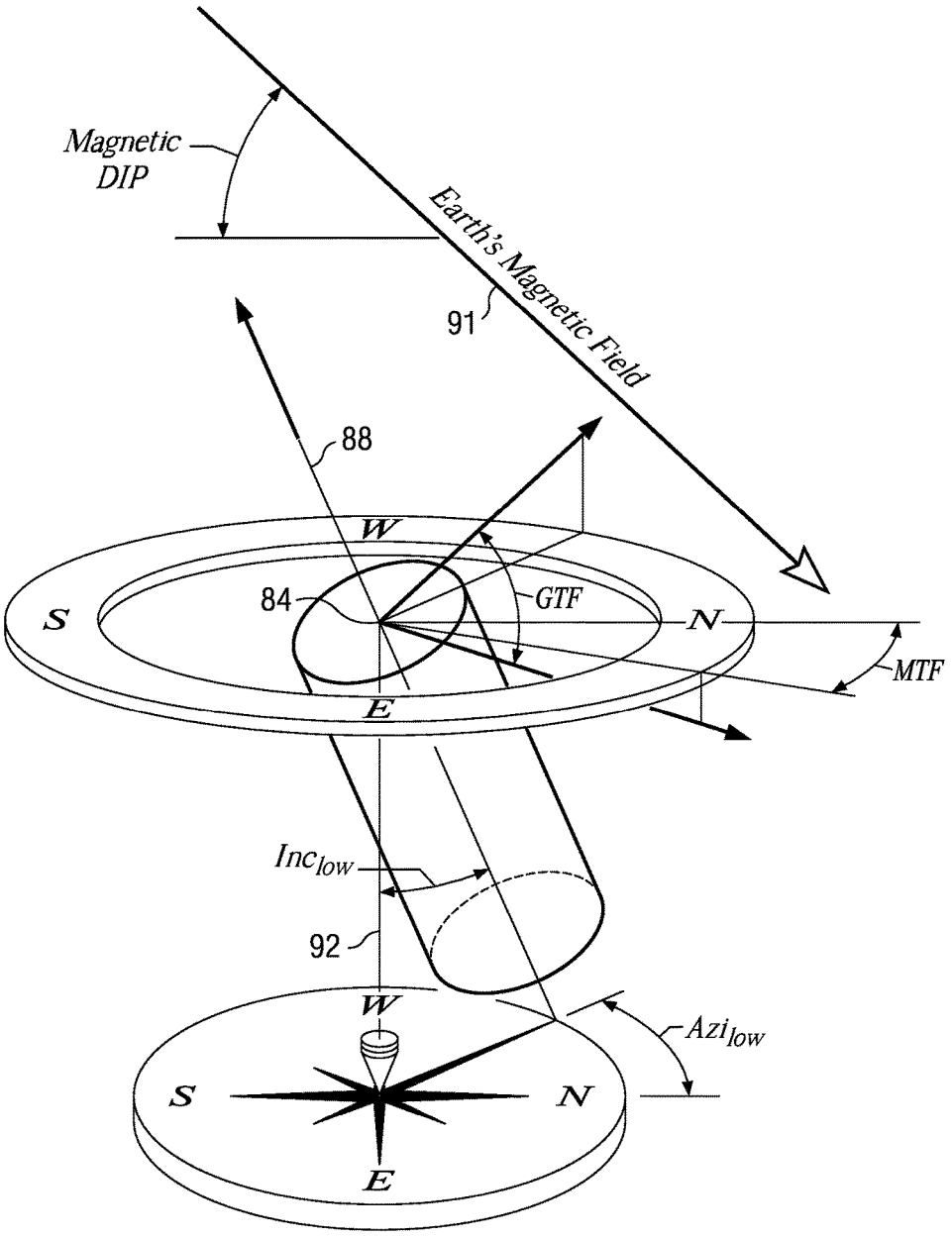
FIG. 4 depicts a diagram of gravity toolface and magnetic toolface in a global reference frame.

FIG. 4 depicts a further diagram of attitude and toolface in a global coordinate reference frame at the second lower survey station 84. The Earth's magnetic field and gravitational field are depicted at 91 and 92. The wellbore inclination $Inc_{low}$ represents the deviation of axis 88 from vertical while the wellbore azimuth $Azil_{low}$ represents the deviation of a projection of the axis 88 on the horizontal plane from magnetic north. Gravity toolface (GTF) is the angular deviation about the circumference of some component of the downhole tool with respect to the highside (HS) of the tool collar (or wellbore). In this disclosure, gravity tool face (GTF) represents the angular deviation between the direction towards which the drill bit is being turned and the highside direction (e.g., in a slide drilling operation, the gravity tool face represents the angular deviation between a bent sub scribe line and the highside direction). Magnetic toolface (MTF) is similar to GTF but uses magnetic north as a reference direction. In particular, MTF is the angular deviation in the horizontal plane between the direction towards which the drill bit is being turned and magnetic north.

It will be understood that the disclosed embodiments are not limited to the above-described conventions for defining wellbore coordinates depicted in FIGS. 2, 3, and 4. It will be further understood that these conventions can affect the form of certain of the mathematical equations that follow in this disclosure. Those of ordinary skill in the art will be readily able to utilize other conventions and derive equivalent mathematical equations.

In current practices, directional drilling methods employ manual operations to implement a kickoff transition from drilling a vertical section of a wellbore to a curved or tangent section of the wellbore. Such manual operations can cause anomalies to inclination and azimuth smoothness as well as anomalies in consistency of dog leg severity of the wellbore in the kickoff.

The present disclosure describes a control mode or process for automated closed-loop control of drilling trajectory during directional drilling. This control mode is referred to as "Auto-Kickoff" herein. The Auto-Kickoff control mode can be configured to automatically control the direction of drilling when drilling the kickoff that transitions the wellbore from a vertical section to a curve or tangent section.

Figure 5:
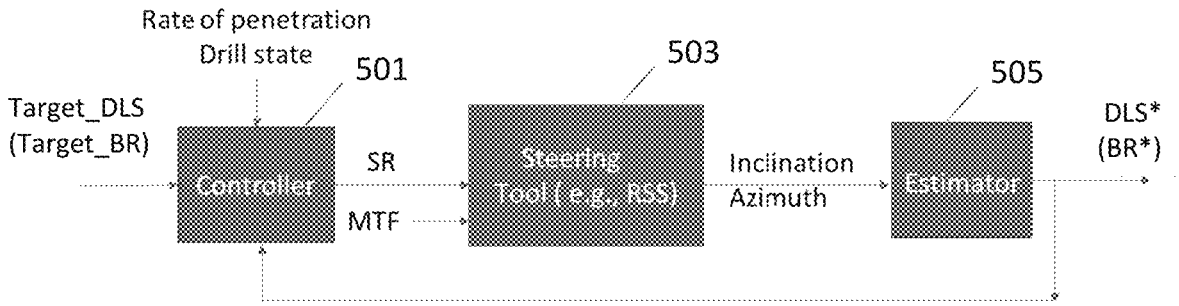
FIG. 5 is a block diagram of a closed-loop control algorithm that implements the automated control methods for drilling a kickoff of a wellbore in accordance with the present disclosure.

In embodiments, the Auto-Kickoff control mode can be implemented by a closed-loop control algorithm as shown in FIG. 5. A controller block 501 is configured to automatically adjust a steering ratio (SR) parameter based on a difference or error between a target dog leg severity (Target_DLS) and an estimated dog leg severity (DLS*) calculated from tool response. Dog leg severity is a measure of the change in the direction of a wellbore over a defined length, normally measured in degrees per 100 feet of length. The SR parameter controls the time that the steering tool (block 503) will spend in holding a desired magnetic toolface (labeled "MTF"). Alternatively, the controller block 501 can be configured to automatically adjust a steering ratio (SR) parameter based on difference or error between a target build rate parameter (Target_BR) and an estimated build rate parameter (BR*) calculated from the tool response. Build rate is a measure of the rate of inclination change versus depth in the wellbore.

Figure 6:
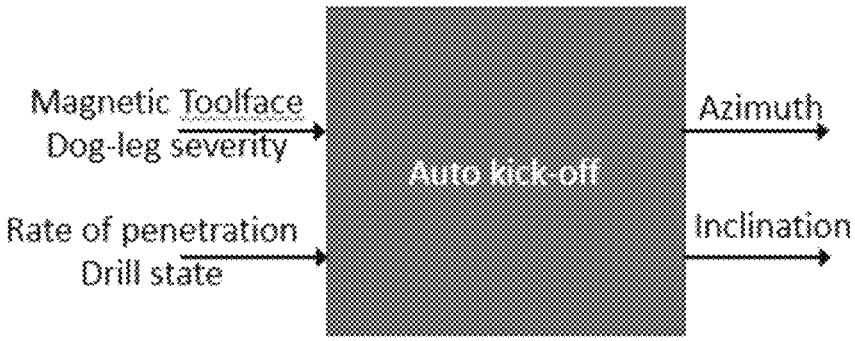
FIG. 6 is a schematic diagram illustrating input and outputs of the automated control methods of the present disclosure.

In embodiments, the inputs to the control algorithm include the desired magnetic toolface (i.e., target azimuth, labeled "MTF"), a target dog leg severity (Target_DLS) (or a target build rate (Target_BR)), rate of penetration (ROP) and drilling state parameters. The inputs can be downlinked to the controller block 501 and/or the steering tool 503 by a user (for example, a user that has a supervisory role), or from a machine that supervises and automatically sends the inputs to the controller block 501 and/or the steering tool 503. The controller block 501 can be located at the surface or downhole depending on the telemetry rate. The rate of penetration (ROP) and drilling state can be either downlinked, measured or estimated. The desired magnetic toolface (MTF) is the target azimuth (angle). The steering tool 503 controls the direction of drilling such that it tracks the desired magnetic toolface (MTF) over a time period controlled by the SR parameter. The desired magnetic toolface (MTF) may need to be set as a ramp of multiple MTFs rather than as only one set-point. In this case, MTF set-point nudges can be performed internally by the steering tool 503 using estimated or elapsed measured depth during drilling. FIG. 6 illustrates inputs and outputs of the auto-kick off control algorithm.

The estimator block 505 calculates the actual or estimated dog leg severity (DLS*) (or the actual or estimated build date (BL*)) from the tool response. In embodiments, the estimator block 505 can use the rate of penetration (ROP) to calculate DLS*. Alternatively, DLS* can be calculated using an overall angle change and threshold (U.S. Pat. No. 10,995,552) and estimated MD is calculated and passed using the max theoretical DLS (e.g., 10 deg/100 ft). For example, if 0.5 deg. corresponds to 5 ft drilled using theoretical DLS, then the actual or estimated DLS* is obtained. There are other ways to calculate DLS* by estimating the positions propagated through the ground. The DLS* (or the BR*) is used as part of the closed loop control algorithm. The target_DLS (or the Target_BR) can be compared to DLS* (or BR*) and the SR parameter is manipulated accordingly. Also, BR and/or turn rate (TR) can be derived and used in the controller block 501. The controller block 501 can be a linear controller (e.g., proportional controller) or a non-linear controller, including a neural network-based controller.

Figure 7A:
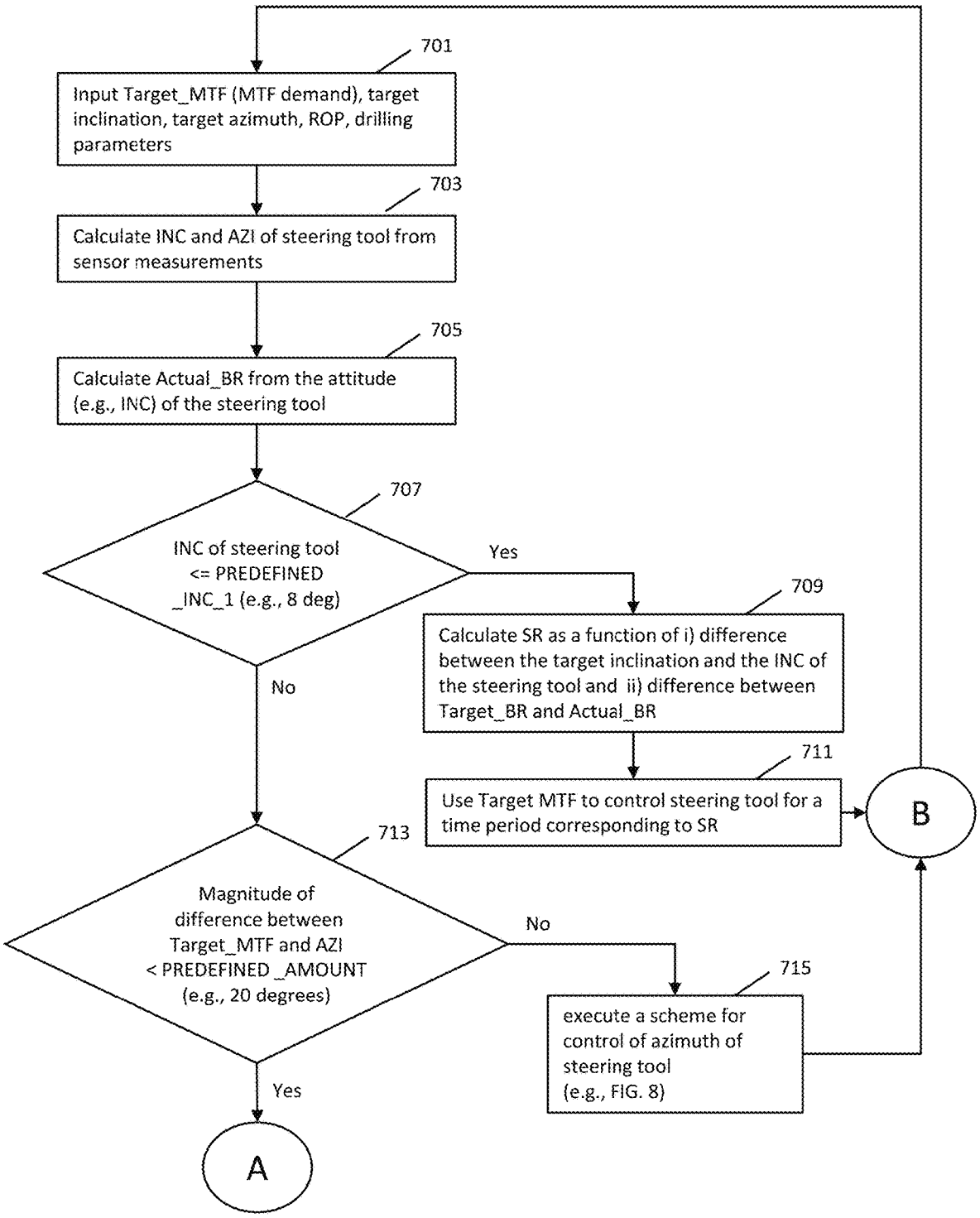
FIGS. 7A and 7B, collectively, is a flow chart of a control algorithm that implements automated control methods for drilling a kickoff of a wellbore in accordance with the present disclosure.
Figure 7B:
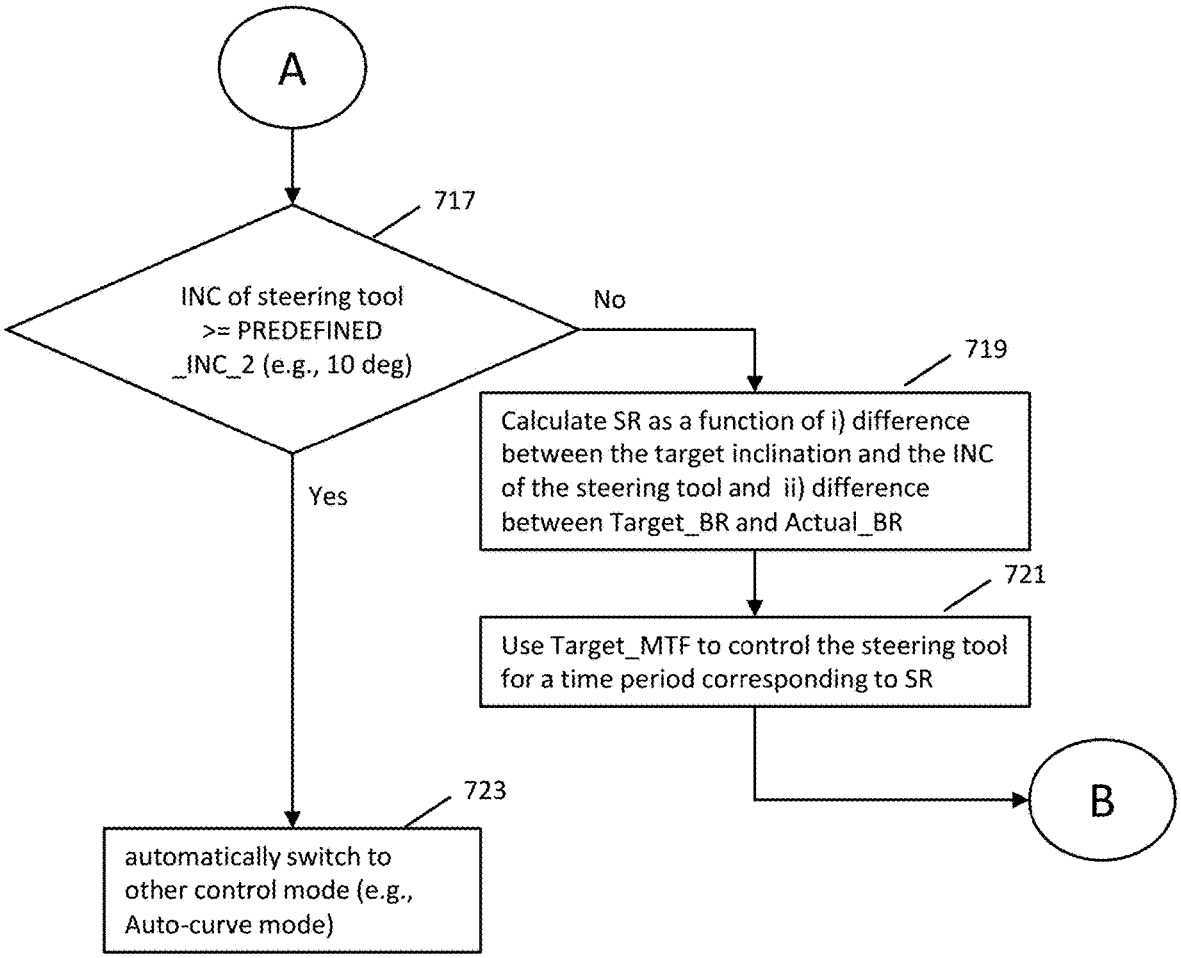

In other embodiments, the Auto-Kickoff control mode can be implemented by a control algorithm as shown in the flow chart of FIGS. 7A and 7B.

In block 701, Target_MTF (i.e., MTF demand), target inclination, target azimuth, ROP, and possibly other drilling parameters are provided as inputs. One or more of these inputs can be communicated or downlinked from a supervisory machine or obtained from local electronic storage that stores tool settings.

In block 703, the attitude (inclination INC (in degrees) and azimuth AZI (in degrees)) of the steering tool (e.g., RSS) is calculated from survey measurements performed by sensors integral to the steering tool as is well known to those of ordinary skill in the art.

In block 705, the current build rate (i.e., actual_BR) of the steering tool can be calculated from the attitude (e.g., inclination INC (in degrees) of the steering tool as calculated in 703. For example, the current build rate (i.e., actual_BR) can be calculated from the difference between the inclination INC (in degrees) of the steering tool as measured by a sensor for the current time (current measurement time) and the inclination INC (in degrees) of the steering tool as measured by the same sensor for a previous time (the measurement time prior to the current measurement time). In another example, the current build rate (i.e., actual_BR) can be calculated from the difference between the inclination INC (in degrees) as measured by two sensors at a given measurement time with a known distance between the two sensors.

In block 707, the control operations check whether the inclination (INC) of the steering tool as calculated in 703 is less than or equal to a predefined inclination value (PREDEFINED_INC_1). If so, the control operations continue to blocks 709 and 711. If not, the control operations continue to block 713. In embodiments, the predefined inclination value (PREDEFINED_INC_1) can be 8 degrees. Another threshold value (for example, a threshold value in the range of 2 to 5 degrees) can be used. The threshold value can be communicated or downlinked from a supervisory machine or obtained from local electronic storage that stores tool settings.

In block 709, the steering ratio SR is calculated as a function of i) difference between the target inclination of 701 and the INC of the steering tool as calculated in 703 and ii) difference between a target build rate (Target_BR) and the current build rate (actual_BR) of 705. In embodiments, the target build rate (Target_BR) can be based on a target dog leg severity (Target_DLS) and/or another input parameter.

In block 711, the Target_MTF of block 701 is used to control the steering tool for a time period corresponding to steering ratio SR as calculated in 709. In this block, the steering tool controls the direction of drilling such that it tracks the desired magnetic toolface (MTF) over a time period controlled by the steering ratio SR of 709. The operations can revert back to block 701 to repeat the control operations as shown.

In block 713, the control operations check whether the magnitude of the difference between the Target_MTF of 701 and the azimuth of the steering tool as calculated on 703 is less than a predefined amount. If not, the control operations continue to block 715. If not, the control operations continue to block 717. In embodiments, the predefined amount can be 20 degrees. Another threshold value can be used. The threshold value can be communicated or downlinked from a supervisory machine or obtained from local electronic storage that stores tool settings.

In block 715, the control operations execute a scheme for control of the azimuth of steering tool.

Note that the operations of blocks 713 and 715 control the accuracy of the azimuth angle of the steering tool during kickoff. Specifically, in the event that the kickoff azimuth falls outside a certain pre-selected threshold (e.g., 20 degrees) at a certain pre-selected inclination angle (e.g., 8 degrees), then the scheme of block 715 is automatically executed. In embodiments, this scheme can be configured to adjust the Target_MTF of the steering tool to control the azimuth of the steering tool and account for any deviations or errors in toolface which could for instance be encountered if there is a toolface offset. An example of such a scheme is described below with respect to FIG. 8. The operations can revert back to block 701 to repeat the control operations as shown.

In block 717, the control operations check whether the inclination (INC) of the steering tool as calculated in 703 is greater than or equal to a predefined inclination value (PREDEFINED_INC_2). If not, the control operations continue to blocks 719 and 721. If so, the control operations continue to block 723. In embodiments, the predefined inclination value (PREDEFINED_INC_2) can be 10 degrees. Another threshold value (for example, a threshold value in the range of 5 to 10 degrees) can be used. The threshold value can be communicated or downlinked from a supervisory machine or obtained from local electronic storage that stores tool settings.

In block 719, the steering ratio SR is calculated as a function of i) difference between the target inclination of 701 and the INC of the steering tool as calculated in 703 and ii) difference between a target build rate (Target_BR) and the current build rate (actual_BR) of 705. In embodiments, the target build rate (Target_BR) can be based on a target dog leg severity (Target_DLS) and/or another input parameter.

In block 721, the Target_MTF of block 701 is used to control the steering tool for a time period corresponding to steering ratio SR as calculated in 719. In this block, the steering tool controls the direction of drilling such that it tracks the desired magnetic toolface (MTF) over a time period controlled by the steering ratio SR of 719. The operations can revert back to block 701 to repeat the control operations as shown.

In block 723, the control operations automatically switch to another control mode (such as an auto-curve control mode) suitable for drilling the build or curve or tangent section of the wellbore that has been kicked-off by the operation of the Auto-Kickoff control mode.

Figure 8:
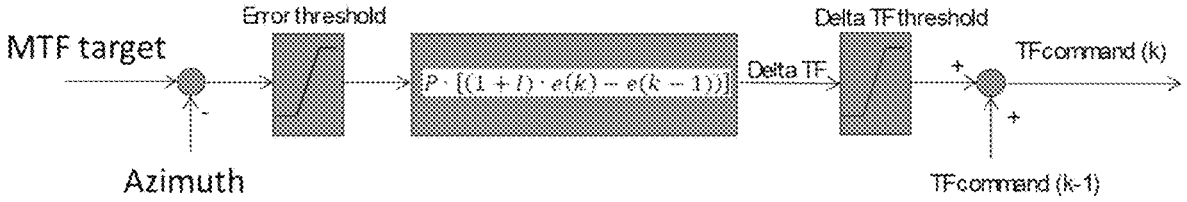
FIG. 8 is a schematic diagram of a proportional-integral (PI) controller configured to process an MTF target to control drilling when drilling a kickoff of a wellbore in accordance with the present disclosure.

FIG. 8 depicts a proportional-integral (PI) controller that may process the Target_MTF to control the direction of drilling controlled by the steering tool. The calculated azimuth AZI of the steering tool obtained from the method of FIGS. 7A and 7B (block 703) may be combined with the magnetic toolface set point value (e.g., the desired magnetic toolface angle) to obtain a toolface error. The toolface error may be subject to thresholding function and a proportional-integral gain stage to obtain a toolface correction (DeltaTF). The toolface correction (DeltaTF) may be subject to a thresholding function and combined with the previous toolface correction (TFcommand (k−1)) to obtain the current toolface correction (TFcommand (k)). The current toolface correction (TFcommand (k)) is the new MTF demand (in degrees) that is applied in the steering tool. The previous toolface correction (TFcommand (k−1)) is the previous MTF demand (in degrees) applied to the steering tool. The proportional gain is represented by the parameter P (in degrees/(degree error). The integral gain is represented by the parameter I (in degrees/(degree error). It will be understood that the control structure depicted on FIG. 8 functions like a proportional integral (P+I) controller for changes in the MTF toolface set point value when responding to toolface disturbances. The disclosed embodiments are of course not limited to any particular type of controller. For example, other controllers such as a proportional controller, a proportional differential controller, or a proportional integral differential controller may be used. Non classic controllers, such as a model predictive controller, a fuzzy controller, and the like may also be used.

The Auto-Kickoff control mode can be activated (manually by instructions from a drilling operator or automatically by instructions from a processor or other programmed controller) during directional drilling.

In embodiments, the Auto-Kickoff control mode can be activated by various mechanisms, such as PowerV and manual mode pages, or manual commands in a downlink map.

In embodiments, the Auto-Kickoff control mode can be activated when the inclination of the wellbore is low (e.g., less than 5 deg).

In embodiments, when the Auto-Kickoff control mode is activated, the steering tool can be configured to the Auto-curve page in the Multi-page downlink map. The MTF, DLS and ROP targets can be pre-set in the tool settings to be used if and when the Auto-Kickoff control mode is activated. These tool settings can be configured to default to set values if not pre-set and can be adjusted by downlinks in the Auto-curve page.

In embodiments, once the inclination of the wellbore is above a certain pre-set inclination value (e.g., 10 deg), the directional drilling control can switch from Auto-Kickoff control mode to another mode (e.g., Auto-curve mode) and the subsequent downlinks will be accepted in the other mode. If the Auto-Kickoff control mode needs to be deactivated before reaching the inclination set for automatic deactivation, sending another command can be configured to override the Auto-Kickoff control mode. This will allow the tool to go to other modes such as HIA, IH, Auto-curve or manual mode.

In embodiments, the Auto-Kickoff control mode can be activated by various conditions or commands, such as: the drilling operator sending one downlink; with the pre-set MTF, DLS and ROP set up in the tool's Auto-Kickoff settings, the tool will begin the Auto-Kickoff control mode in the MTF direction as dictated by the settings; the target DLS and ROP can be set or controlled independently.

In embodiments, during the Auto-Kickoff control mode, the tool can be configured to switch to another mode (e.g., Auto-Curve mode) automatically without requiring action or input from the drilling operator. In embodiments, this can happen once the inclination reaches a predetermined value (e.g., 10 deg). In the follow-on mode, if any turn is required, the TF settings in the Auto-curve page can be used without exiting the Auto-Kick off mode.

In embodiments, the Auto-Kickoff control mode can be deactivated by various conditions or commands. For example, once the inclination reaches a predetermined value (e.g., 20 deg), the tool can be configured to automatically terminate the Auto-Kickoff control mode and transition to another mode (such as Auto-Curve mode with the Auto-Curve settings pre-selected), If a tangent section is required, then the drilling operation can send command DLS=0 from within the Auto-curve page.

The embodiments described herein can be configured for downhole implementation via one or more controllers deployed downhole (e.g., in a steering/directional drilling tool). A suitable controller may include, for example, a programmable processor, such as a microprocessor or a microcontroller and processor-readable or computer-readable program code embodying logic. A suitable processor may be utilized, for example, to execute the method embodiments described above. A suitable controller may also optionally include other controllable components, such as sensors (e.g., a depth sensor), data storage devices, power supplies, timers, and the like. The controller may also be disposed to be in electronic communication with the attitude sensors (e.g., to receive the continuous inclination and azimuth measurements). A suitable controller may also optionally communicate with other instruments in the drill string, such as, for example, telemetry systems that communicate with the surface. A suitable controller may further optionally include volatile or non-volatile memory or a data storage device.

The disclosed embodiments may further include a downhole steering tool having a downhole steering tool body, a steering mechanism for controlling a direction of drilling a subterranean wellbore and sensors for measuring attitude (i.e., inclination and azimuth) of the wellbore as it is drilled. The steering tool may further include a downhole controller including one or more modules that embody a cascade closed-loop control system (e.g., FIG. 5) that processes parameter data and attitude measurements received from the sensors to control the direction of drilling as described herein.

Figure 9:
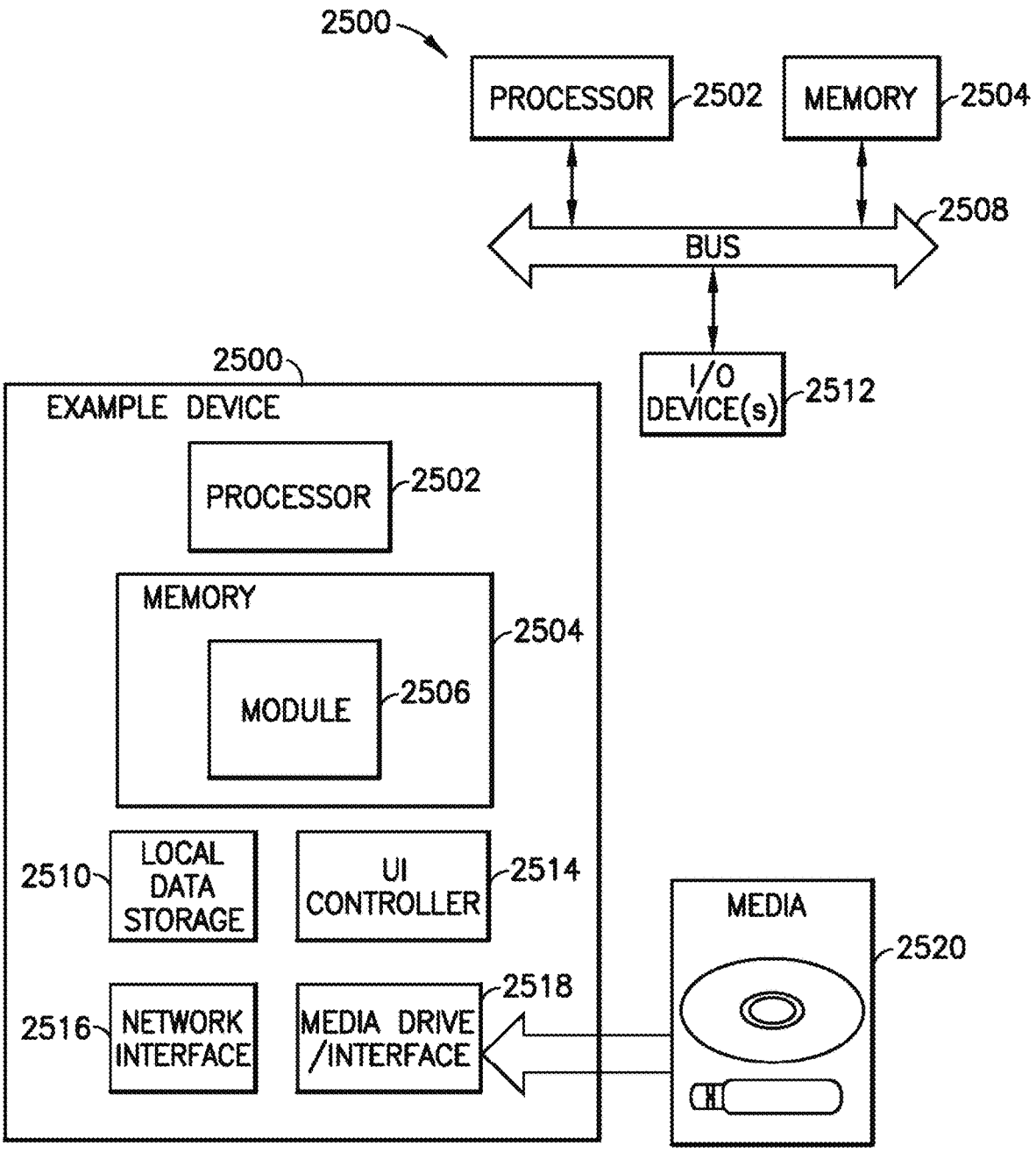
FIG. 9 is a schematic diagram of a computer processing system.

FIG. 9 illustrates an example device 2500, with a processor 2502 and memory 2504 that can be configured to implement various embodiments of the processes and systems as discussed in the present application. For example, various steps or operations of the processes or systems as described herein can be embodied by computer program instructions (software) that execute on the device 2500. Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various processes and systems of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server over a communication network (e.g., the Internet).

Although only a few example embodiments have been described in detail above, those skilled in the art will readily appreciate that many modifications are possible in the example embodiments without materially departing from this invention.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A method for automated closed-loop control of drilling trajectory during directional drilling, the method comprising:

automatically adjusting at least one parameter during directional drilling to automatically control the direction of drilling when drilling a kickoff that transitions a wellbore from a vertical section to a curve or tangent section, wherein the at least one parameter comprises a steering ratio (SR) parameter that controls time that a steering tool will spend in holding a desired magnetic toolface, wherein the automatic adjustment of the steering ratio (SR) parameter is based on a ramp of multiple magnetic toolfaces or magnetic toolface set-point nudges using estimated or elapsed measured depth during drilling.

2. A method according to claim 1, wherein:

the automatic adjustment of the steering ratio (SR) parameter is further based on a difference or error between a target dog leg severity and an estimated dog leg severity calculated from tool response.

3. A method according to claim 1, wherein:

the automatic adjustment of the steering ratio (SR) parameter is further based on difference or error between a target build rate parameter and an estimated build rate parameter calculated from the tool response.

4. A method according to claim 1, wherein:

the automatic adjustment of the steering ratio (SR) parameter is further based on at least one of i) difference or error between a target inclination and measured inclination of the steering tool and ii) difference or error between a target build rate and a current build rate calculated from the measured inclination of the steering tool.

5. A method according to claim 1, wherein:

the automatic adjustment of the steering ratio (SR) parameter is further based on a number of inputs selected from the group including a desired magnetic toolface, a target dog leg severity, a target build rate, a rate of penetration (ROP), and drilling state parameters.

6. A method according to claim 5, wherein:

at least one of the inputs is downlinked by a user or from a machine that supervises and automatically sends the inputs.

7. A method according to claim 1, further comprising:

automatically adjusting magnetic toolface of the steering tool if the magnitude of the difference between the desired magnetic toolface and azimuth of the steering tool at a predefined inclination angle of the steering tool exceeds a predetermined threshold value.

8. A method according to claim 1, further comprising:

terminating the automatic adjustment of the steering ratio (SR) parameter or switching to another control mode when inclination of the steering tool exceeds a predetermined threshold value.

9. A method according to claim 1, wherein:

the automatic adjustment of the steering ratio (SR) parameter is performed by a downhole processor or controller.

10. A method according to claim 1, wherein:

the automatic adjustment of the steering ratio (SR) parameter is activated manually by instructions from a drilling operator or automatically by instructions from a processor or other programmed controller during directional drilling.

11. A control system for automated closed-loop control of drilling trajectory during directional drilling, the control system comprising:

at least one module configured to automatically adjust at least one parameter during directional drilling to automatically control the direction of drilling when drilling a kickoff that transitions a wellbore from a vertical section to a curve or tangent section, wherein the at least one parameter comprises a steering ratio (SR) parameter that controls time that a steering tool will spend in holding a desired magnetic toolface, wherein the automatic adjustment of the steering ratio (SR) parameter is based on a ramp of multiple magnetic toolfaces or magnetic toolface set-point nudges using estimated or elapsed measured depth during drilling.

12. A control system according to claim 11, wherein:

the at least one module is further configured to automatically adjust the steering ratio (SR) parameter based on a difference or error between a target dog leg severity and an estimated dog leg severity calculated from tool response.

13. A control system according to claim 11, wherein:

the at least one module is further configured to automatically adjust the steering ratio (SR) parameter based on difference or error between a target build rate parameter and an estimated build rate parameter calculated from the tool response.

14. A control system according to claim 11, wherein:

the at least one module is further configured to automatically adjust the steering ratio (SR) parameter based on at least one of i) difference or error between a target inclination and measured inclination of the steering tool and ii) difference or error between a target build rate and a current build rate calculated from the measured inclination of the steering tool.

15. A control system according to claim 11, wherein:

the at least one module is further configured to automatically adjust the steering ratio (SR) parameter based on a number of inputs selected from the group including a desired magnetic toolface, a target dog leg severity, a target build rate, a rate of penetration (ROP), and drilling state parameters.

16. A control system according to claim 15, wherein:

at least one of the inputs is downlinked by a user or from a machine that supervises and automatically sends the inputs.

17. A control system according to claim 11, wherein:

the at least one module is further configured to automatically adjust magnetic toolface of the steering tool if the magnitude of the difference between the desired magnetic toolface and azimuth of the steering tool at a predefined inclination angle of the steering tool exceeds a predetermined threshold value.

18. A control system according to claim 11, wherein:

the at least one module is configured to terminate the automatic adjustment of the steering ratio (SR) parameter or switch to another control mode when inclination of the steering tool exceeds a predetermined threshold value.

19. A control system according to claim 11, wherein:

the operations of the least one module is activated manually by instructions from a drilling operator or automatically by instructions from a processor or other programmed controller during directional drilling.

20. The control system according to claim 11, wherein: the at least one module comprises a downhole processor or controller.

* * * * *